US011155963B2

(12) United States Patent
Rand et al.

(10) Patent No.: US 11,155,963 B2
(45) Date of Patent: Oct. 26, 2021

(54) BINDER COMPOSITIONS FOR MAKING CROSSLINKED CELLULOSE FIBER

(71) Applicant: Rohm and Haas Company, Philadelphia, PA (US)

(72) Inventors: Charles J. Rand, Philadelphia, PA (US); William C. Finch, Ambler, PA (US); C. Damien Rodowski, Downingtown, PA (US); Drew E. Williams, Norristown, PA (US)

(73) Assignee: Rohm and Haas Company, Collegeville, PA (US)

( * ) Notice: Subject to any disclaimer, the term of this patent is extended or adjusted under 35 U.S.C. 154(b) by 654 days.

(21) Appl. No.: 15/526,781

(22) PCT Filed: Nov. 20, 2015

(86) PCT No.: PCT/US2015/061807

§ 371 (c)(1),
(2) Date: May 15, 2017

(87) PCT Pub. No.: WO2016/081819

PCT Pub. Date: May 26, 2016

(65) Prior Publication Data

US 2017/0356134 A1 Dec. 14, 2017

Related U.S. Application Data

(60) Provisional application No. 62/082,695, filed on Nov. 21, 2014.

(51) Int. Cl.

| | |
|---|---|
| ***D21H 17/37*** | (2006.01) |
| ***D21C 9/00*** | (2006.01) |
| ***D21H 15/00*** | (2006.01) |
| ***D21H 17/38*** | (2006.01) |
| ***D21H 17/53*** | (2006.01) |
| *D21H 17/10* | (2006.01) |

(52) U.S. Cl.
CPC ..... *D21C 9/005* (2013.01); *D21C 9/002* (2013.01); *D21C 9/007* (2013.01); *D21H 15/00* (2013.01); *D21H 17/37* (2013.01); *D21H 17/38* (2013.01); *D21H 17/53* (2013.01); *D21H 17/10* (2013.01)

(58) Field of Classification Search
CPC ..... D21C 9/005; D21H 17/37
See application file for complete search history.

(56) References Cited

U.S. PATENT DOCUMENTS

| | | | | |
|---|---|---|---|---|
| 3,440,135 | A | 4/1969 | Chung | |
| 3,987,968 | A | 10/1976 | Moore et al. | |
| 4,822,453 | A | 4/1989 | Dean et al. | |
| 4,853,086 | A | 8/1989 | Graef | |
| 4,888,093 | A | 12/1989 | Dean et al. | |
| 4,889,595 | A | 12/1989 | Herron et al. | |
| 4,889,596 | A | 12/1989 | Schoggen et al. | |
| 4,898,642 | A | 2/1990 | Moore et al. | |
| 4,975,209 | A | 12/1990 | Welch et al. | |
| 5,049,235 | A | 9/1991 | Barcus et al. | |
| 5,137,537 | A | 8/1992 | Herron et al. | |
| 5,183,707 | A | 2/1993 | Herron et al. | |
| 5,190,563 | A | 3/1993 | Herron et al. | |
| 5,240,562 | A * | 8/1993 | Phan | A61K 8/0208 162/111 |
| 5,447,977 | A | 9/1995 | Hansen et al. | |
| 5,562,740 | A | 10/1996 | Cook et al. | |
| 5,718,728 | A | 2/1998 | Arkens et al. | |
| 5,749,863 | A | 5/1998 | Payne | |
| 5,755,828 | A | 5/1998 | Westland | |
| 5,779,857 | A | 7/1998 | Norlander | |
| 5,873,979 | A | 2/1999 | Naieni | |
| 6,176,973 | B1 | 1/2001 | Norlander | |
| 6,184,271 | B1 | 2/2001 | Westland et al. | |
| 6,241,780 | B1 | 6/2001 | Arkens et al. | |
| 6,248,879 | B1 | 6/2001 | Anderson et al. | |
| 6,585,780 | B2 | 7/2003 | Koola et al. | |
| 6,716,306 | B2 | 4/2004 | Jewell et al. | |
| 6,752,944 | B2 | 6/2004 | Jewell et al. | |
| 6,780,201 | B2 | 8/2004 | Sun et al. | |
| 6,986,793 | B2 | 1/2006 | Stoyanov et al. | |
| 7,195,695 | B2 | 3/2007 | Sears et al. | |
| 7,288,167 | B2 | 10/2007 | Sears et al. | |
| 7,312,297 | B2 | 12/2007 | Hamed | |
| 7,513,973 | B2 | 4/2009 | Stoyanov et al. | |
| 8,845,757 | B2 | 9/2014 | Weinstein | |
| 2005/0016698 | A1 | 1/2005 | Stoyanov et al. | |
| 2005/0019563 | A1 | 1/2005 | Stoyanov et al. | |
| 2005/0143571 | A1 | 6/2005 | Stoyanov et al. | |
| 2005/0145350 | A1 | 7/2005 | Stoyanov et al. | |
| 2005/0247419 | A1 | 11/2005 | Hamed et al. | |
| 2011/0077354 | A1 | 3/2011 | Stoyanov et al. | |
| 2013/0090425 | A1* | 4/2013 | Wakao | C08F 2/10 524/556 |

* cited by examiner

FOREIGN PATENT DOCUMENTS

| | | | |
|---|---|---|---|
| CN | 103306136 | A | 9/2013 |
| EP | 2206523 | A1 | 7/2010 |

*Primary Examiner* — Jacob T Minskey

(57) ABSTRACT

The present invention provides aqueous compositions for treating fluff pulp comprising (i) one or more acrylic acid polymers containing phosphinate groups and having a weight average molecular weight of from 1,000 to 6,000 and (ii) from 5 to 50 wt. %, based on the total solids weight of the aqueous compositions, of one or more polyethylene glycols, having a formula weight of from 150 to 7,000, or, preferably, from 200 to 600. The present invention also provides individualized, intrafiber crosslinked cellulosic fibers comprising the cellulosic fiber and, in cured form, the aqueous compositions, as well as methods of making the individualized, intrafiber crosslinked cellulosic fibers.

6 Claims, No Drawings

BINDER COMPOSITIONS FOR MAKING CROSSLINKED CELLULOSE FIBER

The present invention relates to aqueous compositions comprising (i) one or more acrylic acid polymers containing phosphinate groups and having a weight average molecular weight of from 1,000 to 6,000 and (ii) one or more polyethylene glycols having a molecular weight of from 200 to 7,000, as well as to individualized, intrafiber crosslinked cellulosic fibers treated with the aqueous compositions.

Individualized, crosslinked cellulose fibers made from pulp which has been sheeted and mechanically individualized or defiberized, also known as "fluff pulp", have enhanced bulk versus uncrosslinked fluff pulp fibers. Fluff pulp has been used extensively in absorbent articles, such as diapers. The desired bulk provided to the crosslinked fluff pulp reduces the density of the pulp, thereby enabling the makers of such absorbent articles to use less pulp while retaining the same or better water capacity and handling function. Historically, polycarboxylic acids such as citric acid and, more recently, polyacrylic acid have been used as crosslinking agents for fluff pulp; however, attainment of a desirable fluff pulp bulk has remained elusive.

U.S. Pat. No. 4,853,086, to Graef, discloses methods of making resilient hydrophilic cellulosic pulp fibers suitable for conversion into an absorbent fluff for products such as disposable diapers. The process comprises treating wet or partially dried cellulosic fiber webs with an aqueous solution of a glycol, such as a polyglycol, and a dialdehyde, such as glyoxal. The product fibers are strong and not discolored. However, the treating composition contains free aldehyde and the product may not be non-toxic because it can generate an unacceptable level of free aldehydes over time.

U.S. Pat. No. 8,845,757 B2, to Weinstein, discloses cellulosic fibers treated with phosphinate telomers of polyacrylic acid crosslinkers having enhanced flow as shown by a low dried glass transition temperature and an ability to penetrate into the cellulosic fibers. However, the Weinstein materials comprise a limited number of compositions that in practice need special handling to prevent viscosity buildup on storage.

The present inventors have sought to solve the problem of providing storage stable fiber treatment compositions for making intrafiber crosslinked fluff pulp that provide an enlarged formulation window for achieving acceptable absorbent capacity and bulk for use in making absorbent articles while increasing the efficiency of the crosslinkers in the compositions.

STATEMENT OF THE INVENTION

1. In accordance with the present invention, compositions for treating fluff pulp comprise (i) one or more acrylic acid polymers containing phosphinate groups and having a weight average molecular weight of from 1,000 to 6,000 and (ii) from 5 to 50 wt. %, or, preferably, from 13 to 40 wt. %, or, from 17 to 36 wt. %, based on the total solids weight of the aqueous compositions, of one or more polyethylene glycols, having a formula weight of from 150 to 7,000 or, preferably, from 200 to 600.

2. The aqueous compositions of item 1, above, wherein the aqueous compositions have a solids content of from 45 to 70 wt. %, based on the total weight of the compositions, or, preferably, 53 to 70 wt. %.

3. The aqueous compositions of any of items 1 or 2, above, wherein the (i) one or more acrylic acid polymers have from 2 to 20 wt. %, or, preferably, from 4 to 15 wt. %, or, more preferably, more than 5 to 15 wt. % of phosphinate groups taken as the amount of phosphorus acid catalysts used to make the acrylic acid polymers, based on the total weight of reactants used to make the acrylic acid polymers.

4. The aqueous compositions of any of items 1, 2, or 3, above, wherein the (i) one or more acrylic acid polymers is polyacrylic acid.

4A. Alternatively, the aqueous compositions for treating fluff pulp comprise (i) one or more acrylic acid polymers containing phosphinate groups and having a weight average molecular weight of from 1,000 to 6,000 and (ii) from 5 to 50 wt. %, or, preferably, from 13 to 40 wt. %, or, from 17 to 36 wt. %, based on the total solids weight of the aqueous compositions, of one or more $C_1$ to $C_2$ alkoxy polyethylene glycols, preferably, methoxy polyethylene glycols, having a formula weight of from 150 to 7,000 or, preferably, from 200 to 600.

5. Individualized, intrafiber crosslinked cellulosic fibers comprising defiberized fluff pulp and the aqueous compositions of any of items 1 to 4A, above, in cured form.

6. The individualized, intrafiber crosslinked cellulosic fibers of item 5, above, wherein the amount of the aqueous compositions in cured form, as solids, ranges from 0.5 to 15 wt. %, or, preferably, from 1 to 10 wt. %, based on the total dry weight of the untreated cellulosic fibers.

7. Methods of using the aqueous compositions of any of items 1 to 4A, above, to form individualized, intrafiber crosslinked crosslinked cellulosic fibers comprising contacting with the aqueous compositions a collection of fluff pulp or a sheet thereof to form treated fluff pulp, and, a) in any order, drying, curing and defiberizing the treated fluff pulp to produce individualized, intrafiber crosslinked fibers, preferably, drying, defiberizing and curing or defiberizing, drying and curing.

8. The methods of item 7, wherein the drying and curing takes place sequentially, in separate steps.

As used herein, the term "aqueous" means water or mixtures of a major proportion of water mixed with a minor proportion of water miscible solvents, or, preferably, water and mixtures of water with up to 20 wt. % of a water miscible solvent, based on the total weight of water and all water miscible solvents.

As used herein, the term "based on the total weight of ethylenically unsaturated monomers" refers to the total weight of addition monomers, such as, for example, vinyl or acrylic monomers, used to make an acrylic acid polymer; unsaturated monomers excludes hypophosphite group containing compounds.

As used herein, the term "in cured form" refers to any composition wherein the acrylic acid polymer is reacted with the cellulosic fiber or fluff pulp, such as by heating, followed by defiberizing, to form fibers having intrafiber crosslinks.

As used herein, the term "solids" refers to the content of the aqueous compositions that is nonvolatile after heating to 150° C. for 30 minutes, including the one or more polyethylene glycols and nonvolatile or reactive liquids.

As used herein, the term fiber "curl" refers to a geometric curvature of the fiber along the longitudinal axis of the fiber. As used herein, the term fiber "twist" refers to a rotation of the fiber along the longitudinal axis of the fiber.

As used herein, unless otherwise indicated, the term "formula weight" refers to the molecular weight of a given compound as reported by its manufacturer or to the weight average molecular weight of a given compound as determined by gel permeation chromatography (GPC) using, for polyethylene glycols, polyethylene glycol standards.

As used herein, the term "molecular weight" or "Mw" refers to a weight average molecular weight as determined by aqueous gel permeation chromatography (GPC) using an Agilent 1100 HPLC system (Agilent Technologies, Santa Clara, Calif.) equipped with an isocratic pump, vacuum degasser, variable injection size auto-sampler, and column heater. The detector was a Refractive Index Agilent 1100 HPLC G1362A. The software used to chart weight average molecular weight was an Agilent ChemStation, version B.04.02 with Agilent GPC-add on version B.01.01. The column set was TOSOH Bioscience TSKgel G2500PWxl 7.8 mm ID×30 cm, 7 μm column (P/N 08020) (TOSOH Bioscience USA South San Francisco, Calif.) and a TOSOH Bioscience TSKgel GMPWxl 7.8 mm ID×30 cm, 13 μm (P/N 08025) column. A 20 mM Phosphate buffer in MilliQ HPLC Water, pH ~7.0 was used as the mobile phase. The flow rate was 1.0 ml/minute. A typical injection volume was 20 μL. The system was calibrated using poly(acrylic acid), Na carboxylate salts as standards from American Polymer Standards (Mentor, Ohio).

As used herein, the term "sheet" or "mat" denotes non-wovens comprising cellulose or other fibers that are not covalently bonded together.

As used herein, the term "polymer" refers to polymers and copolymers comprising one or more residues of a phosphorus acid catalyst, such as a hypophosphite or its salt, like sodium hypophosphite monohydrate, which acts as a chain transfer agent. Where polymers are formed from ethylenically unsaturated monomers consisting of acrylic acid monomer, they are called "homopolymers" and where the polymers are formed from ethylenically unsaturated monomers comprising acrylic acid and another monomer, such as a vinyl or acrylic monomer, they are called "copolymers".

As used herein, the term "wt. %" stands for weight percent.

All ranges recited are inclusive and combinable. For example, a disclosed temperature of 175 to 230° C., preferably, 180° C. or more or, preferably, 220° C. or less, would include a temperature of from 175 to 180° C., from 175 to 220° C., from 180 to 220° C., from 180 to 230° C., and from 175 to 230° C.

Unless otherwise indicated, all temperature and pressure units are room temperature and standard pressure.

All phrases comprising parentheses denote either or both of the included parenthetical matter and its absence. For example, the phrase "(meth)acrylate" includes, in the alternative, acrylate and methacrylate.

In accordance with the present invention, the inventors have found that polyethylene glycol auxiliary compounds improve the crosslinking efficiency of polycarboxylated acids in crosslinking cellulose fibers, thus allowing an effective reduction in their amount. The aqueous compositions of the present invention comprising polyethylene glycols, such as, for example, polyethylene glycol 300 (PEG-300), have allowed for the reduction in the amount of polyacrylic acid used by 30% or more, while maintaining the mechanical performance attributes of the intrafiber crosslinked cellulosic fibers. In addition, in contrast to known crosslinking chemistries (formaldehyde, glyoxal, etc.), the compositions of the present invention have a relatively low toxicity. The resulting intrafiber crosslinked cellulose fibers have particular applicability for use in absorbent structures found in disposable products such as diapers and pads where high loft, low density, high water absorbency, resiliency, and light weight are desired.

In addition, the aqueous compositions of the present invention can be efficiently stored and shipped at high solids contents of from 50 to 70 wt. % without excessive viscosity and hydrogen bond formation. Thus, whereas known aqueous compositions of phosphinate group containing acrylic acid polymers may undergo hydrogen bonding and gel at or below room temperature, the present invention provides compositions that can remain gel free at room temperature and that can be delivered and stored "as is".

In the compositions, the (i) one or more acrylic acid polymers comprise the phosphinate group containing reaction product of acrylic acid or acrylic acid and one or more ethylenically unsaturated comonomer, wherein the total amount of comonomer present is at 10 wt. % or less, based on the total weight of monomers used to make the acrylic acid polymer. Such comonomers may be chosen from other ethylenically unsaturated carboxylic acids, such as, for example, maleic acid, itaconic acid, hydroxyethyl acrylate, hydroxyethyl methacrylate, acrylamide, methacrylamide, 3-allyloxy-1,2-propane-diol, trimethylolpropane allylether or dimethylaminoethyl (meth)acrylate. Preferably, the acrylic acid polymers of the present invention comprise phosphinate group containing polyacrylic acids.

The phosphinate group containing (co)telomers, polymers and copolymers of the present invention have on average at least one phosphinate group. The phosphinate group can be bound to one carbon atom, as a phosphite at the end of a carbon chain, or a diphosphinate having two vinyl polymer backbone substituents, like a dialkyl phosphinate group. The varied structures of the phosphinate groups in such polymers is as described in U.S. Pat. No. 5,294,686 to Fiarman et al.

The preferred phosphorus acid group containing acrylic acid polymers are (co)telomers, polymers and copolymers of acrylic acid that contain as phosphorus acid groups those chosen from hypophosphite groups, alkyl or dialkyl phosphinates, or their salts.

The acrylic acid polymers of the present invention comprise from 2 to 20 wt. %, preferably, 4 wt. % or more, or, preferably, more than 5 wt. %, or, preferably, 15 wt. % or less of a phosphorus acid compound, such as, for example, a hypophosphite compound or its salts, especially alkali metal hypophosphites, e.g. sodium hypophosphite or sodium hypophosphite monohydrate, based on the total weight of reactants (i.e. monomers, phosphorus acid group containing compounds and chain transfer agents) used to make the copolymers.

In accordance with the present invention, the phosphinate group containing acrylic acid polymers can be prepared by hypophosphite chain transfer polymerization of acrylic acid (AA) and any comonomers by conventional aqueous solution polymerization methods.

Copolymers of acrylic acid may include the copolymerization product of acrylic acid and one or more comonomer chosen from one or more of methacrylic acid, maleic acid, itaconic acid, hydroxyethyl acrylate, hydroxyethyl methacrylate, acrylamide, methacrylamide, 3-allyloxy-1,2-propane-diol, trimethylolpropaneallylether, and dimethylaminoethyl (meth)acrylate.

Suitable amounts of acrylic acid in the polymers ranges from 90 to 100 wt. % or more, or, preferably, 92 to 100 wt. % or more based on the total weight of the ethylenically unsaturated monomers used to make the polymers.

Suitable useful amounts of the aqueous compositions of the present invention range from amounts that would provide from 0.1 to 20.0 wt. %, or, preferably, from 1.0 to 10.0 wt. %, as solids, of the compositions, based on the weight of the intrafiber crosslinked cellulosic fibers, calculated on a dry fiber weight basis.

The (ii) one or more polyethylene glycols of the present invention can be chosen from any polyethylene glycols of the desired molecular weight, or their mixtures.

The (ii) one or more polyethylene glycols of the present invention can comprise a polyethylene glycol mixed with a $C_1$ to $C_4$ alkoxy polyethylene glycol, such as a methoxy polyethylene glycol.

To make the aqueous compositions of the present invention, the (ii) one or more polyethylene glycols may simply be mixed with the (i) one or more acrylic acid polymers of the present invention in any order or included in the solution polymerization used to make the acrylic acid polymers.

All cellulosic fibers used in making the individualized, intrafiber crosslinked fibers of the present invention are in the form of fluff pulp. Suitable cellulosic fibers for use making the fluff pulp for use in the present invention may be of diverse natural origin. The optimum fiber source utilized in conjunction with the present invention will depend upon the particular end use contemplated. The cellulosic fibers may be obtained from wood pulp or other sources, including cotton "rag", hemp, grasses, cane, husks, cornstalks, or any other suitable source of cellulose fiber that can be laid into a sheet. Non-crosslinked cellulosic fibers suitable for use in the present invention may be derived primarily from wood pulp. Fibers from esparto grass, bagasse, hemp, flax, and other ligneous and cellulosic fiber sources may be used in the present invention. Completely bleached, partially bleached and unbleached fibers may be used.

Suitable wood pulp fibers for use in making fluff pulp can be obtained from well-known chemical processes such as the kraft and sulfite processes, with or without subsequent bleaching. Softwoods and hardwoods can be used. Details of the selection of wood pulp fibers are well known to those skilled in the art. Such suitable fibers are commercially available from a number of companies, including Weyerhaeuser Company (Federal Way, Wash. and Georgia Pacific, LLC (Atlanta, Ga.). For example, suitable cellulose fibers produced from southern pine that are suitable for use in the present invention are available from Weyerhaeuser Company under the designations CF416, CF405, NF405, PL416, FR416, FR516, and NB416. Dissolving pulps from northern softwoods include MACII Sulfite, M919, WEYCELL™ pulp and TR978 all of which have an alpha content of 95% and PH which has an alpha content of 91%. Cellulose fibers that are suitable in the present invention are also available from Georgia Pacific as Golden Isles™ fluff pulp grades. Pulp fibers can also be processed by thermomechanical, chemithermomechanical methods, or combinations thereof. Groundwood fibers, recycled or secondary wood pulp fibers, and bleached and unbleached wood pulp fibers can all be used.

Preferably, the cellulosic fibers used in the present invention are those made by chemical pulping processes, or the digested fibers from softwood, hardwood or cotton linters.

More preferably, the cellulosic fibers used in the present invention comprise at least partially bleached pulp, such as those from wood fibers, for its superior brightness and consumer appeal.

Most preferably, for products such as paper towels and absorbent pads for diapers, sanitary napkins, catamenials, and other similar absorbent paper products, the cellulosic fibers come from southern softwood pulp due to their premium absorbency characteristics.

The cellulosic fibers may be supplied in slurry, unsheeted form or sheeted form. Preferably, the cellulosic fibers are never-dried fibers. In the case of dry lap, it is advantageous to moisten the fibers prior to mechanical disintegration to minimize damage to the fibers.

The individualized, intrafiber crosslinked cellulosic fibers of the present invention can be formed by applying the compositions of the present invention to a mat of cellulose fiber or fluff pulp, defiberizing or separating the treated mat into individual fibers, and then curing the cross-linking agent at a temperature sufficiently high to cause crosslinking or reaction between the acrylic acid polymer and reactive sites within the cellulosic fiber.

Various methods, devices and systems for contacting the aqueous compositions with the fluff pulp, and then forming individual fibers having intrafiber crosslinks. In general, the cellulosic fibers may be prepared by an apparatus as described in U.S. Pat. No. 5,447,977, to Hansen et al., wherein the cellulosic fibers are conveyed as a mat of cellulose fibers through a fiber treatment zone. In the fiber treatment zone, an applicator applies a treatment composition to the fibers. Downstream, a fiberizer completely defiberizes the cellulose fibers from the mat to form a fiber output comprised of substantially unbroken cellulose fibers. Finally, a dryer coupled to the fiberizer for flashing evaporates residual moisture cures the treatment composition to form dried and cured, intrafiber crosslinked cellulosic fibers. In another example, U.S. Pat. No. 3,440,135, to Chung, discloses a mechanism for applying a crosslinking agent to a cellulosic fiber mat, then passing the mat while still wet through a fiberizer, such as a hammermill to defiberize the mat, and drying the resulting loose fibers in a two stage dryer. The first dryer stage is at a temperature sufficient to flash water vapor from the fibers and the second dryer stage is at a temperature that effects curing of the crosslinking agent.

The aqueous compositions of the present invention may be contacted with the cellulosic fibers by any method known in the production of treated fibers, such as, for example, by passing the fluff pulp fibers as a fiber sheet through a bath containing the compositions, by applying compositions to the fluff pulp, such as by spraying the fluff pulp and pressing it, or dipping the fluff pulp into the composition and pressing it. Fiber treatment may be done with sprayers, saturators, size presses, nip presses, blade applicators and foam applicators to apply the compositions. Preferably, the compositions are applied uniformly. The wetted cellulosic fibers can be passed between a pair of impregnation rollers which assist in distributing the compositions uniformly through the cellulosic fiber mat. Rollers cooperatively apply light pressure on the mat (for example, 0.006 to 0.01 MPa) to force the compositions uniformly into the interior of the mat.

The treated cellulosic fibers of the present invention can be, on one hand, dried and cured and, on the other hand, defiberized in any order.

The treated cellulosic fibers should generally be dewatered and may then be dried. The workable and optimal consistencies will vary depending upon the type of defiberizing equipment used. Preferably, the cellulosic fibers are dewatered and dried to a solids content of from 20 to 80 wt. % or fiber and moisture, or, more preferably, from 40 to 80 wt. %. Drying the fibers to within these preferred ranges generally will facilitate defiberization of the fibers into individualized form without excessive formation of knots associated with higher moisture levels and without high levels of fiber damage associated with lower moisture levels. Dewatering may be accomplished by such methods as mechanically pressing, centrifuging, or air drying the cellulosic fibers.

After dewatering, the fibers are then mechanically defiberized.

Preferably, the cellulosic fibers of the present invention are mechanically defiberized into a low density, individualized, fibrous form known as "fluff pulp" prior to curing with the acrylic acid polymer with which the fibers have been treated from the aqueous compositions of the present invention.

Mechanical defiberizing may be performed by a variety of methods which are presently known in the art. One such method for defiberizing cellulosic fibers includes, but is not limited to, those described in U.S. Pat. No. 3,987,968, including treatment with a Waring™ blender (Conair Corp., Stamford, Conn.), and tangentially contacting the fibers with a rotating disk refiner, hammer mill or wire brush. Regardless of the particular mechanical device used to form the fluff pulp, the cellulosic fibers are mechanically treated while initially containing at least 20 wt. % moisture, or, preferably, while containing from 20 to 60 wt. % moisture. Mechanical refining of fibers at high concentration or as partially dried fibers may also be used to provide curl or twist to the fibers in addition to curl or twist imparted as a result of mechanical defiberization.

Preferably, an air stream is directed toward the fibers during such defiberization to aid in separating the fibers into substantially individual form.

The defiberized fibers are then dried to a solids content of from 60 to 100 wt. % by methods known in the art as flash drying or jet drying. This imparts additional twist and curl to the fibers as water is removed from them. The amount of water removed by the flash drying step may be varied; however, drying to a higher solids content provides a greater level of fiber twist and curl than does flash drying to a solids content in the lower part of the 60 to 100 wt. % range. Preferably, the treated fibers are dried to a solids content of from 90 to 95 wt. %. Flash drying the fibers to a 90 to 95 wt. % solids content also reduces the amount of drying which must be accomplished in the curing following flash drying.

Drying temperatures from 90 to 165° C., or, preferably, from 125 to 150° C. for periods of from 3 to 60 minutes or, preferably, from 5 to 20 minutes, all at standard pressure, will generally provide acceptable fibers having moisture contents less than 10 wt. %.

Once the fibers are treated with the aqueous compositions of the present invention, the aqueous compositions are caused to react with the fibers or cure in the substantial absence of interfiber bonds. Curing time depends upon factors including the moisture content of the fibers, cure temperature, pH of the composition and the fibers, as well as the amount and type of catalyst used and the method used for heating and/or drying the fibers during cure. Curing at a particular temperature for fibers of a certain initial moisture content will occur at a higher rate when accompanied by a continuous, air-through drying than when subjected to drying/heating in a static oven.

The formation of ester bonds is favored under acidic reaction conditions. Preferably, curing of the fibers treated with the aqueous compositions of the present invention takes place at a pH of from 1.5 to 5, or, more preferably, from pH 2.0 to pH 4.5, or, most preferably, from pH 2.1 to 3.5.

The aqueous compositions of the present invention may be cured by heating the aqueous composition treated fiber at a temperature of from 120 to 225° C. or, preferably, from 140 to 200° C.

Curing times may range from 0.5 to 60 minutes, or, preferably, from 5 to 15 minutes.

Preferably, curing takes place separately from and after drying at temperatures ranging from 120 to 225° C. for periods of from 1 to 20 minutes, or, from 170 to 190° C. for from 2 to 15 minutes.

Those skilled in the art will appreciate that higher temperatures and forced air convection decrease the time required for drying or curing. Curing temperatures should be maintained at less than 225° C., or, preferably less than 200° C. because exposure of the fibers to such high temperatures may lead to darkening or other damaging of the fibers.

The maximum level of curing will be achieved when the fibers are essentially dry (having less than 5 wt. % moisture). In the absence of water, the fibers are crosslinked or cured while in a substantially unswollen, collapsed state.

Preferably, drying and curing the treated cellulosic fibers is carried out sequentially rather than at once.

Preferably, drying and/or curing are carried out in an air-through oven.

Following curing, the fibers may be washed. After washing, the fibers are defluidized and again dried. The fibers while still in a moist condition may be subjected to a second mechanical defiberization step which causes the fibers to twist and curl between the defluidizing and drying steps. The same apparati and methods previously described for defiberizing the fibers are applicable to this second mechanical defibration step.

As used herein, the term "defiberization" refers to any of the procedures which may be used to mechanically separate the fibers into substantially individual form, even though the fibers may already be in such form. In defiberization, the mechanical treatment a) separates the fibers into substantially individual form if they were not already in such form, and b) imparts curl and twist to the fibers upon drying.

In another known sheet curing process for making individualized, crosslinked fibers, the cellulosic fibers in a sheet form are contacted with a solution containing the aqueous compositions of the present invention. The fibers, while in sheeted form, are dried and cured, preferably by heating the fibers to a temperature of from 120 to 160° C. Subsequent to curing, the fibers are mechanically separated into substantially individual form, preferably by treatment with a fiber fluffing apparatus such as the one described in U.S. Pat. No. 3,987,968 or other methods for defiberizing fibers as is known in the art. Dry fiber to fiber bonding when the fibers are treated as a sheet restrains the fibers from twisting and curling with increased drying. Compared to individualized, intrafiber crosslinked fibers made by drying the fibers in defiberized form, the absorbent materials containing the relatively untwisted fibers made by the sheet curing process are expected to exhibit lower wet resiliency and lower responsiveness to wetting. Accordingly, one can mechanically separate the cellulosic fibers in the form of a sheet into substantially individual form between the drying and the curing step. Thus, the cellulosic fibers are thereby individualized prior to curing to facilitate intrafiber crosslinking.

EXAMPLES

In the following examples, unless otherwise specified, all temperatures are room temperature (20 to 22° C.) and all pressures are standard pressure (1 atm).

In the following examples, Polymer 1 is polyacrylic acid having a Mw of 2,700 comprising the polymerization product of acrylic acid monomer and from 9 to 11 wt. % sodium hypophosphite monohydrate (SHP), based on the total weight of monomers used to make the polymer. Polymer 1 has a 50 wt. % solids content.

In the following examples, Polymer 2 is polyacrylic acid having a Mw of 5,000 comprising the polymerization product of acrylic acid monomer and ~6 wt. % (SHP), based on the total weight of monomers used to make the polymer. Polymer 2 has a 46 wt. % solids content.

In the following examples, glycerol is used as a 99 wt. % solids material, dextrose monohydrate is used at 90 wt. % solids, and all polyethylene glycols and methoxy polyethylene glycols are used at 99.9 wt. % solids.

In the following examples, the term "PEG" refers to polyethylene glycol, the term "MPEG" refers to methyl terminated polyethylene glycol and, unless otherwise indicated, the number following each term refers to the formula weight of the given material.

The materials in the indicated examples, below, were subject to the following test methods to assess performance:

Add-on (%):

The indicated fluff pulp fiber substrate is weighed and then immersed in the indicated aqueous compositions to form treated fluff pulp. The binder soaked substrate is weighed and add-on is calculated from the difference between this weight multiplied by the solids content of the binder and the weight of the original fluff pulp substrate. Then the treated fluff pulp is dried at, unless otherwise stated, 90° C. for 6 minutes.

5 k Density (5 k):

A 4.22 g sample of treated, individualized, and cured fluff pulp fibers is laid by dropping them onto a screen using a vacuum assist to pull fibers onto the screen) onto a 7.62 cm×7.62 cm square. The square is then inserted in a Carver press (Wabash, Ind.) and 200,170 N is applied to the square, which is then immediately released. The sheet is turned 90 degrees, flipped and again 200,170 N is again applied and immediately released. Thickness is measured at the four corners and the center using an Ames bench top comparator (Waltham, Mass.). Each cured fiber sample is trimmed to a 7.62 cm×7.62 cm square which is weighed and then the 5 k density is calculated. Four samples were run for each example tested, and the average of the four results are given in Table 2, below.

Absorbency Under Load (AUL):

One end of a glass tube having a length of 15.24 cm, an inner diameter (ID) of 2.49 cm and two open ends is fitted with fritted glass and flared for support. The fitted glass tube is weighed (W0) after being fully submerged in a 0.9% (w/w) NaCl saline solution (Sigma Aldrich, St. Louis, Mo.) in a trough and padded dry to account for water uptake by the fritted glass. In all absorbency tests, roughly 0.5 grams of the indicated cured, treated individualized fluff pulp composition is added into the fitted glass tube which is again weighed (Wi). A disc of glass having an outer diameter that fits inside the fitted tube is inserted into the non-fritted end of the fitted tube so as to apply 19.3 KPa force to the treated, cured and individualized fluff pulp. The saline solution trough is placed on a scale to ensure that the saline level is the same for the start of each individual test; and then the fritted end of the fitted glass tube containing the glass fibers is submerged in the saline solution trough to fully submerge the cured, individualized fluff pulp. The individualized, cured pulp is then allowed to absorb the saline solution for 3 minutes followed by removing the fitted glass tube containing the pulp from the saline and allowing the pulp to dry for 1 minute at room temperature in the fitted glass tube. After this absorption, the disc is removed and the remainder of the filled, fritted tube is weighed (Wf). For each example, absorbency under load is a ratio, calculated as follows:

$$\text{Absorbency under load}\left(\frac{g}{g}\right) = \frac{Wf - Wi}{Wi - W0}$$

The Absorbency under load test was repeated 3 times for each example and the average was reported in Table 2, below.

L*a*b (Color Space):

The L*a*b color space was evaluated for a 7.62 cm×7.62 cm square of treated, individualized, and cured fluff pulp fibers as made for the 5 k density test, above, using a Spectro-Guide™ 45/0 from BYK-Gardner (Columbia, Md.) spectrophotometer calibrated as per manufacturer recommendations. Each determination, as reported in Table 2, below, was the mean of 5 measurements per sample (the four corners and a point in the center).

Examples 1 to 11

In the Examples in Table 1, below, the indicated materials were mixed shaken by hand for 30 seconds then warmed in a 60° C. oven for 1 hour and shaken again by hand for 30 seconds. All of the compositions in Table 1, below, were adjusted to 4.95 wt. % solids in water and then were tested as indicated in Table 2, below. Each aqueous composition in Table 1, below, was applied to Golden Isles™ (Grade 4881) cellulosic fiber mat (Georgia-Pacific Cellulose, LLC Atlanta, Ga.). An approximately 50 gram non-woven sheet of the cellulosic fiber sheet (mat) was immersed in the aqueous compositions indicated in Table 2, below, and then dried at 90° C. for 6 minutes. The sheet was weighed prior to addition of the aqueous compositions and prior to drying to obtain an add-on, this is shown in Table 2, below. The sheets were then mechanically defiberized with a blender in a container that is modified to draw fibers into the blender blades and then past the blender to a collection zone using partial vacuum; and then the individualized fluff pulp was then cured at 200° C. in an oven for 5 minutes to give the individualized, intrafiber crosslinked fibers.

As shown in Table 2, below, the aqueous compositions of the present invention in Example 3, with acrylic acid polymer and the polyethylene glycol, give fluff pulp a significantly higher bulk (lower density) than Polymer 1 alone in comparative Example 1 and a dramatically higher bulk than an aqueous composition with glycerol in comparative Example 5. In addition, the aqueous compositions of Example 3 give fluff pulp significantly higher absorbency than the acrylic acid polymer alone in comparative Example 1 and dramatically higher absorbency than the compositions with glycerol in comparative Example 5. All of this is so even though the aqueous compositions of the present invention have about a 25 wt. % loading of the PEG 300. Thus, the aqueous compositions of the present invention provide acrylic acid polymer crosslinkers that are more than 33% more efficient than the comparative art.

TABLE 1

Individualized Intrafiber Crosslinked Fibers from Aqueous Compositions

| Example | Crosslinker (i)/ Amount (g) | Auxiliary (ii) (g) PEG 300 | PEG 4k | Other | dextrose | Water (g) |
|---|---|---|---|---|---|---|
| 1* | Polymer 1/30 | | | | | 274 |
| 2 | Polymer 1/35.8 | 2 | | | | 365 |
| 3 | Polymer 1/30 | 5 | | | | 370 |
| 4 | Polymer 1/18.5 | 5 | | | | 265 |
| 5* | Polymer 1/30 | | | 5[1] | | 370 |
| 6 | Polymer 1/30 | | 5 | | | 370 |
| 7 | Polymer 1/30 | | | 5[2] | | 370 |
| 8 | Polymer 2/32.8 | 5 | | | | 368 |
| 9* | Citric Acid/15 | | | | | 288 |
| 10* | Citric Acid/15 | 5 | | | | 382 |
| 11* | Polymer 1/30 | | | | 5.5 | 368 |

*Denotes Comparative Example;
[1]Glycerol;
[2]Methoxy polyethylene glycol formula weight 350).

TABLE 2

Performance Of The Aqueous Compositions

| Example | Add-on | 5k ($g/cm^3$) | AUL (g/g) | L | A (color space) | B |
|---|---|---|---|---|---|---|
| 1* | 9.3% | 0.230 | 22.92 | 94.37 | −0.04 | 5.99 |
| 2 | 9.4% | 0.228 | 23.44 | 94.09 | −0.13 | 5.75 |
| 3 | 9.3% | 0.211 | 23.61 | 94.92 | 0.15 | 4.92 |
| 4 | 9.3% | 0.233 | 22.45 | 94.61 | 0.09 | 6.00 |
| 5* | 9.4% | 0.257 | 20.86 | 95.19 | 0.08 | 5.11 |
| 6 | 9.3% | 0.224 | 20.85 | 95.02 | −0.05 | 5.58 |
| 7 | 9.4% | 0.218 | 22.76 | 94.36 | 0.12 | 6.16 |
| 8 | 9.4% | 0.244 | 24.05 | 94.60 | 0.06 | 6.36 |
| 9* | 9.8% | 0.371 | 18.43 | 89.70 | 1.74 | 15.98 |
| 10* | 9.8% | 0.481 | 18.42 | 93.31 | 0.89 | 10.54 |
| 11* | 9.2% | 0.283 | 19.88 | 87.75 | 1.91 | 19.07 |

*Denotes Comparative Example

As shown in Table 2, above, the aqueous compositions of the present invention in Examples 2 to 4, and 6 to 8 provide individualized, intrafiber crosslinked fibers with dramatically higher bulk than citric acid or dextrose containing compositions, respectively, in comparative Examples 9, 10, and 11. Further, the aqueous compositions of Examples 2 to 4, 6 and 8, with polyethylene glycols having a range of molecular weights provide enhanced crosslinking efficiency for acrylic acid polymers of varying molecular weight. In each such example, the absorbency under load is as good as, or better than, the same compositions in comparative Examples 1 and 5, with the same acrylic acid polymers at a much higher solids loading; the inventive Examples maintain the absorbency under load with the same acrylic acid polymer but at a polymer concentration of 10% less (compare Example 2 to comparative Example 1), of 25% less (compare Examples 3, 6 and 8 to comparative Example 1), and of over 35% less (compare Example 4 to comparative Example 1). Also shown in Table 2, above, the best results occurred when the polyethylene glycol was present at from 15 to 30 wt. %, based on the solids of the aqueous compositions; further, though the lower molecular weight acrylic acid Polymer 1 gave slightly better results, the higher molecular weight acrylic acid Polymer 2 performed very well and proved that the aqueous compositions of the present invention enable fluff pulp treatment compositions having a much wider range of acrylic acid polymer formulations than previously known at the same level of performance. All inventive compositions provided products having an acceptable, not a darkened, color.

We claim:

1. An aqueous composition for treating fluff pulp comprising (i) one or more acrylic acid polymers containing phosphinate groups and having a weight average molecular weight of from 1,000 to 6,000 and (ii) from 5 to 50 wt. %, based on the total solids weight of the aqueous compositions, of one or more polyethylene glycols, having a formula weight of from 150 to 7,000, wherein said treating fluff pulp with said aqueous composition forms intrafiber crosslinked cellulosic fibers.

2. The aqueous composition as claimed in claim 1, wherein the amount of the (ii) one or more polyethylene glycols ranges from 13 to 40 wt. %, based on the total solids weight of the aqueous compositions.

3. The aqueous composition as claimed in claim 1, wherein the (ii) one or more polyethylene glycols has a formula weight of from 200 to 600.

4. The aqueous composition as claimed in claim 1, wherein the aqueous compositions have a solids content of from 50 to 70 wt. %, based on the total weight of the compositions.

5. The aqueous composition as claimed in claim 1, wherein the (i) one or more acrylic acid polymers have from 2 to 20 wt. % of phosphinate groups taken as the amount of phosphorus acid catalysts used to make the acrylic acid polymers based on the total weight of reactants used to make the acrylic acid polymers.

6. The aqueous composition as claimed in claim 1, wherein the (i) one or more acrylic acid polymers is polyacrylic acid.

* * * * *